US006881012B2

(12) United States Patent
Covington

(10) Patent No.: US 6,881,012 B2
(45) Date of Patent: Apr. 19, 2005

(54) FOUNDATION REPAIR SYSTEM AND METHOD OF INSTALLATION

(76) Inventor: Gregory R. Covington, 8538 C del, Houston, TX (US) 77055-1119

( * ) Notice: Subject to any disclaimer, the term of this patent is extended or adjusted under 35 U.S.C. 154(b) by 0 days.

(21) Appl. No.: 10/730,733

(22) Filed: Dec. 8, 2003

(65) Prior Publication Data

US 2004/0141814 A1 Jul. 22, 2004

Related U.S. Application Data

(63) Continuation of application No. 10/131,296, filed on Apr. 24, 2002, now abandoned.

(51) Int. Cl.[7] ..... E02D 5/00

(52) U.S. Cl. ..... 405/230; 405/252; 405/231; 405/232

(58) Field of Search ..... 405/232, 230, 405/231, 251, 252

(56) References Cited

U.S. PATENT DOCUMENTS

| | | | | |
|---|---|---|---|---|
| 2,011,459 A | | 6/1935 | Snow et al. | 61/56 |
| 2,065,507 A | * | 12/1936 | Alexander | 405/252 |
| 2,351,288 A | * | 6/1944 | Gordon | 405/252 |
| 3,422,630 A | * | 1/1969 | Marier | 405/252 |
| 4,239,419 A | | 12/1980 | Gillen, Jr. | 405/232 |
| 4,695,203 A | * | 9/1987 | Gregory | 405/230 |
| 4,708,528 A | * | 11/1987 | Rippe | 405/230 |
| 5,096,333 A | * | 3/1992 | Bassett | 405/252 |
| 5,228,807 A | * | 7/1993 | Willcox, Jr. | 405/232 |
| 5,288,175 A | | 2/1994 | Knight | 405/230 |
| 5,399,055 A | | 3/1995 | Dutton, Jr. | 405/230 |
| 6,179,526 B1 | | 1/2001 | Knight et al. | 405/232 |
| 6,200,070 B1 | | 3/2001 | Knight | 405/232 |

FOREIGN PATENT DOCUMENTS

EP 0 413 422 A1 2/1991

* cited by examiner

*Primary Examiner*—Frederick L. Lagman
(74) *Attorney, Agent, or Firm*—Kenneth H. Johnson

(57) ABSTRACT

A continuously interlocked segmental precast concrete underpinning pile using a method of installation where a cooperating extension on one segment engages a cooperating depression on an adjacent segment and aligns the precast segments during installation, which provides a laterally stable pile. With the addition of an adhesive, a locking engagement or both the piling has both linear and rotational stability.

4 Claims, 3 Drawing Sheets

FOUNDATION REPAIR SYSTEM AND METHOD OF INSTALLATION

This is a continuation of application Ser. No. 10/131,296 filed on Apr. 24, 2002 now abandoned.

BACKGROUND OF THE INVENTION

1. Field of the Invention

The invention relates to the repair of building foundations by underpinning. More specifically, it relates to a method for aligning pile segments during installation, inspecting pile penetration depth, and continuously reinforcing an improved segmental precast concrete pile used for underpinning repairs.

2. Related Art

Precast concrete pile segments are used in the underpinning of building foundations comprising vertically stacked, unconnected, precast concrete segments. These segments are pressed or driven vertically into the soil one at a time until adequate load capacity is obtained. This system came into favor because it required low clearance under the structure being leveled and did not require a predrilled hole, with concurrent hauling of removed dirt and pouring of cement. Poured cement piers can leave a structure and the surrounding lawns in disrepair for several weeks because of the curing time. Similarly, a one piece precast concrete pile is rarely used for underpinning because it requires heavy equipment to install, and is impossible to install beneath an existing building without requiring an exorbitant amount of demolition to provide adequate clearance. The stacked precast segments pile has several significant disadvantages the principal one being that the pile segments are not aligned, other than being stacked on each other, and detrimental misalignments can occur.

U.S. Pat. No. 5,288,175 addressed the deficiencies with a precast concrete starter segment with a high strength steel strand extending from its center and precast concrete pile segments constructed with strand ways which are threaded onto the steel strand and aligned for installation in the same manner as the starter segment. This pile is wholly dependent on the steel cable for alignment. The high strength steel is subject to highly corrosive conditions from the concrete and the soil and special procedures such as the use of construction adhesives to bond and seal the cable and the segments or the use of stainless steel. If the cable fails, this system is little better than the prior unconnected segments.

SUMMARY OF THE INVENTION

The present invention provides a method and structures for aligning precast concrete pile segments as they are installed, and upon completion of installation provides a continuously reinforced segmental precast concrete underpinning pile.

Briefly the present invention comprises a concrete segment having a generally longitudinal configuration with two ends, each of said ends having an element for engagement with a cooperating element of an adjacent segment. By combining a plurality of the segments with the cooperating elements engaged in the ground, a piling is created. The cooperative engagement provides lateral stability of the piling stacking a plurality of such precast one on another.

Installation of subsequent segments continues until adequate load capacity and depth are obtained. The pile penetration depth can be easily determined upon completion by simply counting the segments used.

This method of installation provides an aligned, concrete underpinning pile of verifiable depth, installed under conditions with almost no clearance, such as beneath an existing building.

DETAILED DESCRIPTION OF THE INVENTION

The invention provides a completed pile that is equivalent to a one piece precast concrete pile of the same dimensions. The diameter or width of a segment is commonly 6-inches, with the segment being precast of concrete having a minimum compressive strength of 3000-psi or more. Normally the segments will have a cylindrical form. A rectangular or other cross section may be used. A structural adhesive, typically a 2-component epoxy, may be used to bond the concrete segments one to another during their assembly in the ground as pile.

Installation equipment typically comprises incidental hand tools to excavate access tunnels or holes and hydraulic jacks with an electric pump. Because the precast components and equipment are small in nature, the underpinning operations usually require only limited clearance, or head room, and support locations will be beneath the perimeter or interior of a building. The dimensions, reinforcing requirements and location of the pile are site specific, and depend primarily on the soil conditions and structural loads needing to be supported.

The structural adhesive may be a 2-component epoxy having a minimum compressive strength of 6,000-psi and a minimum bond strength of 1000-psi, such as an ASTM C-881, Type VI bonding system. Normal penetration requirements range from a minimum of about 7-ft, up to possibly 20-ft or more, with most installations being around 12-ft and is normally determined by a desired resistance being obtained in the soil penetration.

As can be appreciated when used the epoxy is not of a fast setting type, preferably allowing a series of precast segments to be placed, since some degree of movement may be expected as the pile segments are added and driven into the ground. The need for epoxy between the segments of the pile is dependent on the nature of the soil into which they are driven. Normally the weight of the structure will be enough to maintain the contact between the segments. Also the cooperating interlocking components may have slots and lugs to secure the segments from the vertical movement, with or without an adhesive.

The process of installing may include steps of removing a volume of earth from beneath a portion of a structure, positioning a first pile segment below said portion of said structure, placing a jack between said first pile segment and said portion of said structure, driving a first pile segment a distance into unexcavated earth. The first pile segment has an end extending out of the earth having a first cooperating element for engaging a second cooperating on a second pile segment, fully engaging said first and second cooperating elements to seat said second pile segment onto said first pile segment; and driving said second pile segment another distance into the earth.

Figure 1:
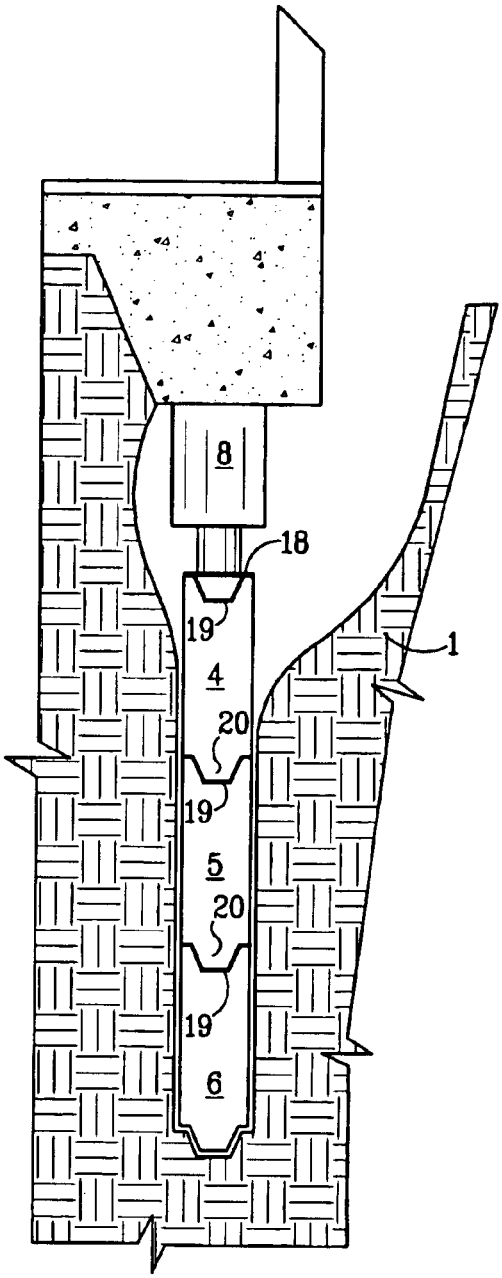
FIG. 1: A side view of a preferred embodiment showing installation of the present invention segments beneath the perimeter of an existing structure.

FIG. 1 is a side view of a preferred embodiment of the invention for the installation of several segments, where a hydraulic jack 8 presses the pile segments 4, 5 and 6 into the soil 1 pushing against the weight of the structure 9. A flat plate 18 is used on the piston of the hydraulic jack to bridge the cooperating depression 19. Multiple pile segments 4, 5, and 6 are sequentially mounted by inserting cooperating projections 20 into cooperating depressions 19 for installation and aligned by the connection. When the desired depth or penetration resistance is reached the underpinning installation is backfilled with soil fill (not shown).

Figure 2:
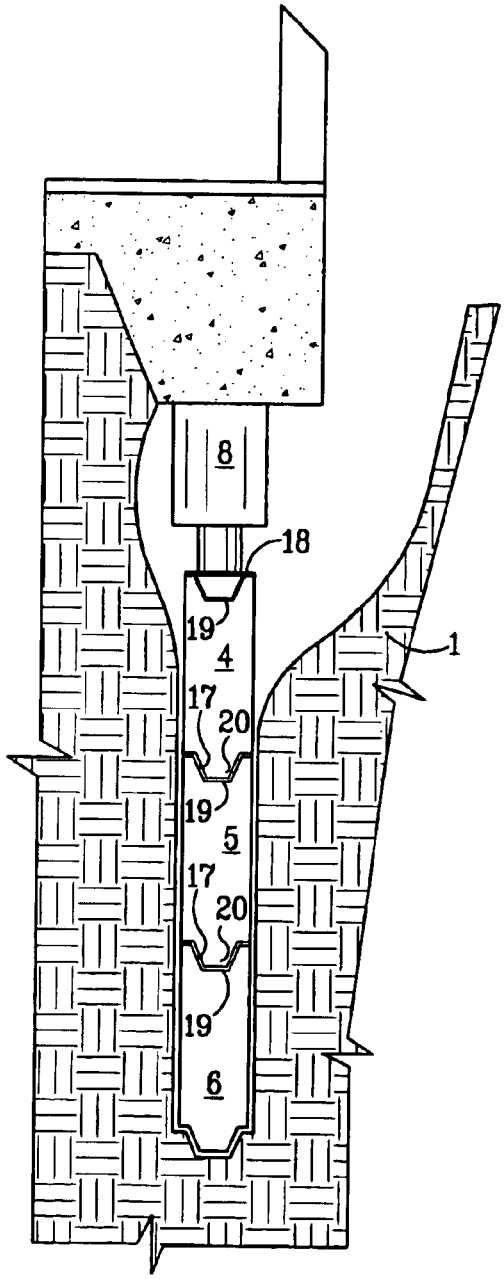
FIG. 2: A side view of a preferred embodiment showing installation of the present invention segments beneath the perimeter of an existing structure with an adhesive.

FIG. 2 differs from FIG. 1 by having adhesive 17 inserted in the connection between cooperating projection 20 and depression 19.

Figure 3:
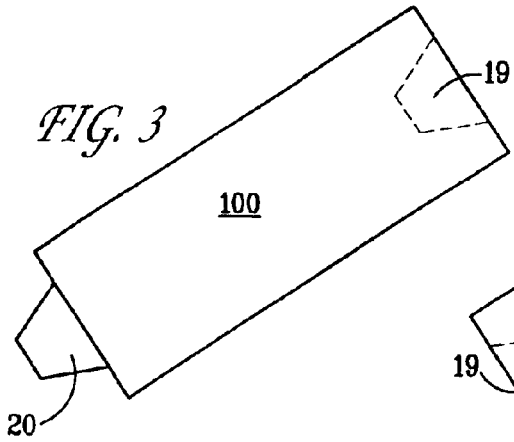
FIG. 3: A side cross sectional view of a preferred embodiment of a segment.

FIG. 3 is a generally cylindrical segment 100 having a projection 20 on one end and a depression 19 on the other end. The projection and slots are preferably cooperating such that there is tight fit. As shown the projections are trapezoidal, and the depression is the same. In this configuration the segments mounted together are laterally stable and also rotationally stable. In some configurations such as a cylindrical shape cooperating components rotational stability can be obtained with adhesive.

Figure 4:
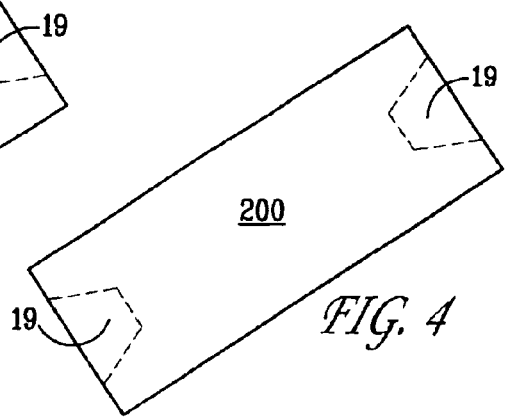
FIG. 4: A side cross sectional view of another embodiment of a segment.

FIG. 4 is a segment 200 with a depression 19 at each end.

Figure 5:
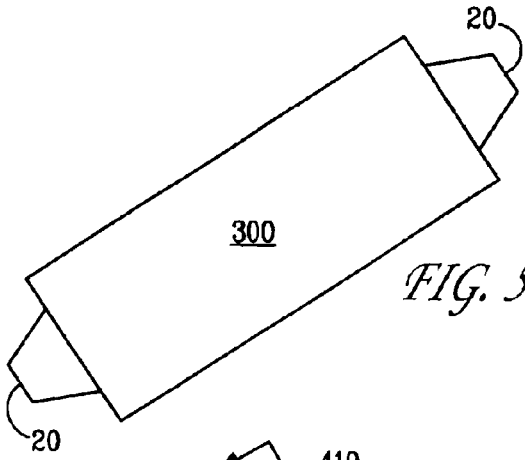
FIG. 5: A side cross sectional view of another embodiment of a segment.

FIG. 5 is a segment 300 with an extension 19 at each end.

Figure 6:
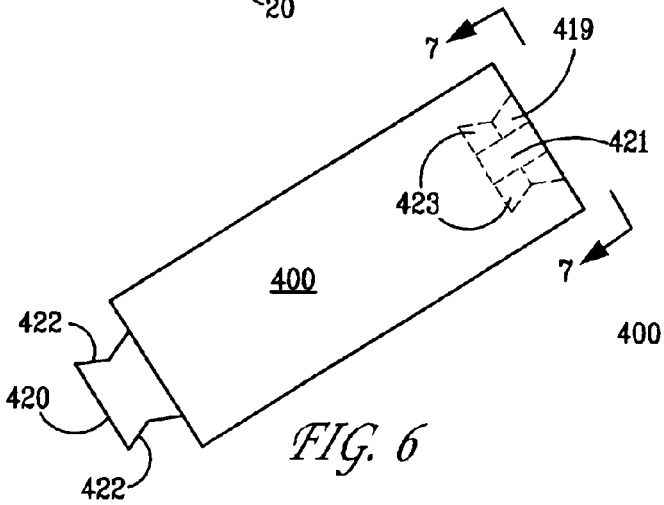
FIG. 6: A side cross sectional view of another embodiment of a segment with a lug and locking slot.
Figure 7:
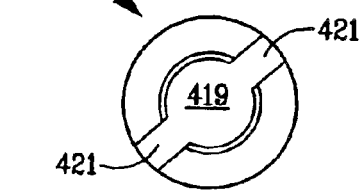
FIG. 7: A plan view from 7—7 of an entire segment of the embodiment of FIG. 6.

FIG. 6 is a segment 400 with an extension 420 and a cooperating depression 419. This segment is designed to have a rotational locking feature. The tabs 422 are engaged into slots 421 and the extension 420 seated entirely into the depression 419 and rotated to engage the tabs 422 in slots 423.

Figure 8:
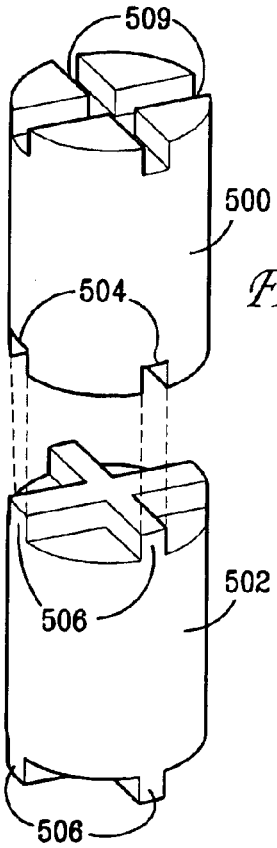
FIG. 8: is an exploded prospective view of a pair of cooperative segments of a first configuration.
Figure 9:
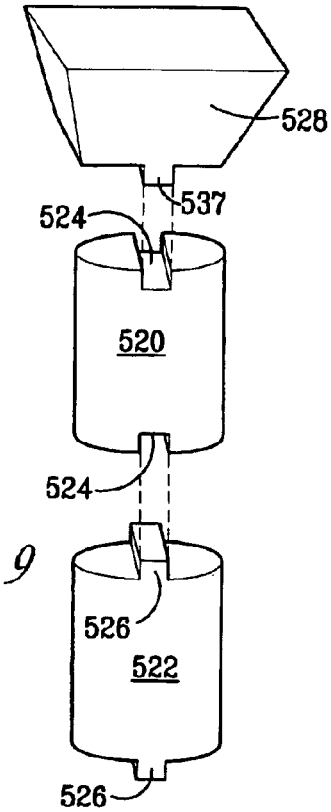
FIG. 9: is an exploded prospective view of a pair of cooperative segments of a second configuration.
Figure 10:
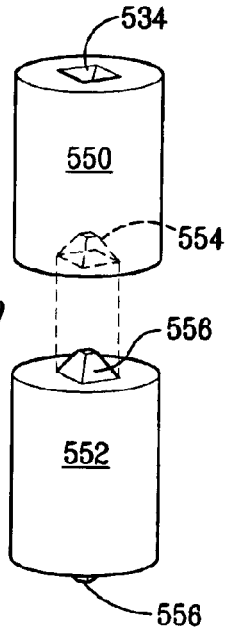
FIG. 10: is an exploded prospective view of a pair of cooperative segments of a third configuration.

FIGS. 8, 9 and 10 each show a pair of engagement configurations exploded in vertical alignment from engagement. In FIG. 8 the segment 500 has an intersecting depression 504 on both ends with one end aligned with a second segment 502 which has cooperating intersecting projections 506 which engage in the depression 504. FIG. 9 shows a variation of the engagement of FIG. 8 in that the depression 524 on segment 520 is a single slot and the cooperating projection 526 is a single straight ridge. FIG. 10 shows a pyramidal project 556 on segment 552 for cooperative engagement in a corresponding depression 554 in segment 550.

It will be appreciated that the bottom segment in a piling may not have any engagement means on its lower end and further that the uppermost or any other segment may engage cooperatively with a segment of a configuration other than elongated, such as a flat element 528 (a footing) with projection 530 as shown in FIG. 9.

What is claimed is:

1. An underpinning pile forming segment comprising a body defining a cylindrical configuration, having a first end and a second end, said first end comprising a cooperating extension affixed on said first end for engaging and interlocking with a cooperating depression affixed on a first different underpinning pile and said second end comprising a cooperating depression affixed on said second end for engaging and interlocking with a cooperating extension affixed on a second different underpinning pile, wherein said depression has a bottom and at least one slot extending into said depression and a second slot extending annularly about said bottom of said depression into a wall of said depression.

2. An underpinning pile forming segment comprising a body defining a cylindrical configuration, having a first end and a second end, said first end comprising a cooperating extension, said extension has at least one tab on a distal end thereof, for engaging a cooperating depression and interlocking with a cooperating element affixed on a first different underpinning pile and said second end comprising a cooperating depression, said depression having a bottom and at least one slot extending into said depression and a second slot extending annularly about said bottom of said depression into a wall of said depression, for engaging a cooperating extension and interlocking with a cooperating element affixed on a second different underpinning pile.

3. A process of installing segmented underpinning plies for supporting a structure upon the earth comprising the steps of:

removing a volume of earth from beneath a portion of the structure;

positioning a first pile segment below said portion of said structure, said first pile segment comprising a body defining a cylindrical configuration, having a first end and a second end, (a) said first end comprising a cooperating extension affixed on said first end for engaging and interlocking with a cooperating depression affixed on a first different underpinning pile and (b) said second end comprising a cooperating depression affixed on said second end for engaging and interlocking with a cooperating extension affixed on a second different underpinning pile, wherein said depression has a bottom and at least one slot extending into said depression and a second slot extending annularly about said bottom of said depression into a wall of said depression;

placing a jack between said first pile segment and said portion of said structure;

driving said first pile segment a distance into unexcavated earth said first pile segment having an end extending out of the earth for engaging and interlocking with a second cooperating element affixed on a second pile segment comprising a body defining a cylindrical configuration, having a first end and a second end, (a) said first end comprising a cooperating extension affixed on said first end for engaging and interlocking with a cooperating depression affixed on a first different underpinning pile and (b) said second end comprising a cooperating depression affixed on said second end for engaging and interlocking with a cooperating extension affixed on a second different underpinning pile, wherein said depression has a bottom and at least one slot extending into said depression and a second slot extending annularly about said bottom of said depression into a wall of said depression;

engaging and interlocking a cooperating end of said first pile segment with a cooperating end of said second pile segment; whereby lateral stability of the interlocked pile segments is provided in the absence of a connecting cable between said pile segments; and driving said second pile segment another distance into the earth.

4. A process of installing segmented underpinning piles for supporting a structure upon the earth comprising the steps of:

removing a volume of earth from beneath a portion of the structure;

positioning a first pile segment below said portion of said structure, said first pile segment comprising a body defining a cylindrical configuration, having a first end and a second end, (a) said first end comprising a cooperating extension, said extension has at least one tab on a distal end thereof, for engaging a cooperating depression and interlocking with a cooperating element affixed on a first different underpinning pile and (b) said second end comprising a cooperating depression, said depression having a bottom and at least one slot extending into said depression and a second slot extending annularly about said bottom of said depression into a wall of said depression, for engaging a cooperating extension and interlocking with a cooperating element affixed on a second different underpinning pile;

placing a jack between said first pile segment and said portion of said structure;

driving said first pile segment a distance into unexcavated earth said first pile segment having an end extending out of the earth for engaging and interlocking with a second cooperating element affixed on a second pile segment comprising a body defining a cylindrical configuration, having a first end and a second end, (a) said first end comprising a cooperating extension, said extension has at least one tab on a distal end thereof, for engaging a cooperating depression and interlocking with a cooperating element affixed on a first different underpinning pile and (b) said second end comprising a cooperating depression, said depression having a bottom and at least one slot extending into said depression and a second slot extending annularly about said bottom of said depression into a wall of said depression, for engaging a cooperating extension and interlocking with a cooperating element affixed on a second different underpinning pile;

engaging and interlocking a cooperating end of said first pile segment with a cooperating end of said second pile segment; whereby lateral stability of the interlocked pile segments is provided in the absence of a connecting cable between said pile segments; and driving said second pile segment another distance into the earth.

* * * * *